US006012564A

United States Patent [19]

Mukai

[11] Patent Number: 6,012,564

[45] Date of Patent: Jan. 11, 2000

[54] PAPER PROCESSING APPARATUS

[75] Inventor: Masanori Mukai, Kawasaki, Japan

[73] Assignee: Fujitsu Limited, Kawasaki, Japan

[21] Appl. No.: 09/060,346

[22] Filed: Apr. 15, 1998

[30] Foreign Application Priority Data

Dec. 8, 1997 [JP] Japan ..... 9-336888

[51] Int. Cl.[7] ..... G07F 7/04; B07C 5/00

[52] U.S. Cl. ..... 194/206; 209/534

[58] Field of Search ..... 194/206, 207; 209/534; 235/379

[56] References Cited

U.S. PATENT DOCUMENTS 3,602,643 8/1971 Wright, Jr. ..... 209/534
4,628,194 12/1986 Dobbins et al. ..... 235/379
4,883,183 11/1989 Kimura et al. ..... 194/206
4,928,230 5/1990 Kawamura et al. ..... 209/534

FOREIGN PATENT DOCUMENTS 3-113590 5/1991 Japan ..... 194/206

*Primary Examiner*—Robert P. Olszewski
*Assistant Examiner*—Bryan Jaketic
*Attorney, Agent, or Firm*—Staas & Halsey

[57] ABSTRACT

A paper processing apparatus has a conveyance unit for conveying a paper at a conveyance velocity according to an operation mode, and a discriminating unit adapted to vary a discrimination processing for the paper in accordance with the conveyance velocity.

4 Claims, 15 Drawing Sheets

PRIOR ART

PRIOR ART

PRIOR ART

PRIOR ART

PRIOR ART

PRIOR ART

PAPER PROCESSING APPARATUS

BACKGROUND OF THE INVENTION

1. Field of the Invention

The present invention relates to a paper processing apparatus wherein papers such as paper money and the like are discriminated while they are conveyed, and a conveyance path for a paper is altered in accordance with a discrimination result, and more particularly an apparatus for processing paper money, which is incorporated into an automatic teller machine (hereinafter, referred to as an ATM) for executing transactions such as receipt of money, payment, etc.

2. Description of the Related Art

As a paper processing apparatus incorporated into an ATM, there has been known a so-called BRU (Bill Recycle Unit) in which a plurality of sorts of paper money thrown by users of the ATM are discriminated and received with sorting, and when a payment from the ATM to users is performed, the payment is performed using the paper moneys received with sorting.

FIG. 11 is a sectional view of the earlier developed BRU.

The ATM, into which the BRU is incorporated, further incorporates thereinto a coin handling apparatus for handling coins, a touch keyboard through which users of the ATM operate the ATM, a reader for reading a cash card, a reader for reading a passbook, and the like. Users of the ATM stand at the right side of the FIG. 11 to throw paper moneys and make other performance. Hereinafter it happens that the right side of the FIG. 11 is referred to as a "front side" and the left side of the FIG. 11 is referred to as a "back side".

The BRU 900 is provided with a 1,000-yen bill stacker 901, a 10,000-yen bill stacker 902, a 5,000-yen bill box 903 and a fetch and receipt mechanism 904. The 1,000-yen bill stacker 901, the 10,000-yen bill stacker 902, and the 5,000-yen bill box 903 receive paper moneys with sorting for each sort of money. The 5,000-yen bill box 903 serves as a buffer for temporarily stores 5,000-yen bills. The 1,000-yen bill stacker 901 and the 10,000-yen bill stacker 902 accommodate paper moneys by the fetch and receipt mechanism 904, or paper moneys are fetched from the 1,000-yen bill stacker 901 and the 10,000-yen bill stacker 902 by the fetch and receipt mechanism 904. 1,000-yen bills and 10,000-yen bills accommodated in the 1,000-yen bill stacker 901 and the 10,000-yen bill stacker 902 are utilized for a payment of the paper moneys from the ATM to users. 5,000-yen bills stored in the 5,000-yen bill box 903 are collected without being utilized for a payment of the paper moneys.

At the upper of the back side of the BRU 900, there is provided a reject box 905 for accommodating shape abnormal bills. The reject box 905 is provided with a 5,000-yen bill chamber 9051 for accommodating 5,000-yen bills via the 5,000-yen bill box 903.

At the upper of the front side of the BRU 900, there are provided a throw box 906 movable between two positions upward and downward, and a fetch mechanism 9061 for fetching paper moneys from the throw box 906. When the throw box 906 is located upward, a paper money is thrown by a user from the exterior of the ATM into the throw box 906, or alternatively, a paper money is fetched by a user to the exterior.

When the throw box 906 is located downward, a paper money, which is to be transferred from the ATM to a user, is accommodated into the throw box 906, or alternatively, a paper money is fed by the fetch mechanism 9061 from the throw box 906 into the BRU 900.

The throw box 906 is partitioned into two spaces by a partition plate 9062. One of the two spaces is used to accommodate paper moneys thrown by users, and another is used to accommodate, of paper moneys fed from the throw box 906 into the BRU 900, a paper money which is abnormal in its shape, and the like.

At the back side of the BRU 900, there are provided two detachable cassettes 907 each having a paper money chamber 9071 and a reject chamber 9072. At the bottom portion of each of the cassettes 907, there is provided a fetch mechanism 908 for fetching paper moneys from the cassette 907. And at the top portion of each of the the cassettes 907, there is provided an accommodating mechanism 909 for causing paper moneys to be accommodated into the cassette 907. When a manager of the ATM collects paper moneys from the ATM, paper moneys stored in the two stackers 901 and 902 are transferred to the paper money chamber 9071 of the cassette 907. When a manager of the ATM supplements paper moneys to the ATM, paper moneys stored in the paper money chamber 9071 of the cassette 907 are transferred to the two stackers 901 and 902. A bill involved in an abnormality in its shape and the like, which are detected during a transfer of paper moneys from the cassette 907 to the two stackers 901 and 902, are accommodated into the reject chamber 9072. Incidentally, of the two cassettes 907 the cassette of the right side is a spare cassette, which is used when an amount of paper moneys stored in the two stackers 901 and 902 exceeds a tolerance capacity of the cassette of the left side, in case of collection of paper moneys.

At the somewhat upper side from the center of the BRU 900, there is provided a discriminating unit 910 for detecting a paper money to perform a discrimination including a decision of sorts of money, a determination as to authenticity of bills, etc. in accordance with a result of the detection.

The BRU 900 further comprises conveyance rollers 911, a DC motor 912, and a conveyance belt 913. The conveyance belt 913 is driven by the DC motor 912 supported by the conveyance rollers 911 to convey paper moneys from some portion to another portion inside the BRU 900, and also to permit paper moneys to pass through the discriminating unit 910. Details of a conveyance path will be described later.

The conveyance belt 913 may convey a paper money even if the paper money somewhat slants with respect to a conveyance direction. In association with this feature, the discriminating unit 910 is so arranged that it may discriminate also a paper money which is conveyed at a slant.

In the BRU 900, there is provided a gate 914 for each branch point of the conveyance path. The gate 914 alters the conveyance path. FIG. 11 shows only a typical gate 914 for each branch point, and omits other gates 914.

At the bottom side of the BRU 900, there is provided an overall control unit 915 for performing an overall control of the BRU 900. The overall control unit 915 also serves to read a discrimination result of the discriminating unit 910, so that the gate 914 is driven in accordance with the discrimination result to alter the conveyance path, which will be described below.

FIG. 12 is a typical illustration useful for understanding a method of altering the conveyance path by the gate 914.

FIG. 12 shows an example of the branch point of the conveyance path. A paper money, which has been conveyed from the left side of the figure along a conveyance path 9130, is conveyed on a conveyance path 9131 directed to the lower side of the figure along a conveyance roller 911, or on a conveyance path 9132 straight directed to the right side of the figure.

The gate 914 is of a wedge-like configuration, and is disposed between the conveyance path 9132 directed to the right side of the figure and the conveyance path 9131 directed to the lower side of the figure in such a manner that the tip of the gate 914 is oriented toward the branch point. The gate 914 rotates on a rotary axis 9142 by a gate magnet 9141 which is controlled by the overall control unit 915 shown in FIG. 1.

When the gate 914 is controlled, as shown with a solid line, in such a manner that the tip of the wedge is oriented toward the upper side, the paper money conveyed from the left side of the figure is conveyed downward along the gate 914. On the other hand, when the gate 914 is controlled, as shown with a dotted line, in such a manner that the tip of the wedge is oriented toward the lower side, the paper money conveyed from the left side of the figure is conveyed to the right side along the gate 914.

Again referring to FIG. 11, there will be explained the BRU 900.

The BRU 900 has four operation modes (a money receipt mode, a payment mode, a supplement mode and a collection mode). Upon receipt of a designation of the operation modes from the exterior, the overall control unit 915 performs an overall control for the BRU 900 in accordance with the designation.

In the money receipt mode, a user of the ATM throws paper moneys to the ATM. The paper money thrown into the throw box 906 by the user of the ATM is fed into the inside of the ATM, discriminated, sorted and separately accommodated in the two stackers 901 and 902 and the 5,000-yen bill box 903 in the associated sorts, respectively.

In the payment mode, a payment of paper moneys from the ATM to users is performed. A paper money to be paid to a user of the ATM is fetched from the stackers 901 and 902 and is discriminated to be accommodated in the throw box 906.

In the supplement mode, a manager of the ATM supplements paper moneys to the ATM. Paper moneys stored in the cassette 907 are fetched therefrom and discriminated to be accommodated into the stackers 901 and 902.

In the collection mode, a manager of the ATM collects paper moneys from the ATM. Paper moneys stored in the stackers 901 and 902 are fetched therefrom and discriminated to be accommodated into the cassette 907.

FIGS. 13–15 are views each showing a BRU which is the same as the BRU 900 of FIG. 1. An arrow indicated by a heavy line shown in FIG. 11 denotes a conveyance path for paper moneys in the money receipt mode. Likewise, an arrow indicated by a heavy line shown in FIG. 13 denotes a conveyance path for paper moneys in the payment mode; an arrow indicated by a heavy line shown in FIG. 14 denotes a conveyance path for paper moneys in the supplement mode; and an arrow indicated by a heavy line shown in FIG. 15 denotes a conveyance path for paper moneys in the collection mode.

First, an operation of the BRU 900 in the money receipt mode will be explained referring to FIG. 11 hereinafter.

The throw box 906 is first located upward. When paper moneys are thrown into the throw box 906 by a user of the ATM, the throw box 906 is translated to the lower position. At that time, the paper moneys thrown into the throw box 906 enters the lower side of the partition plate 9062 of the throw box 906. Those paper moneys are taken out one by one by the fetch mechanism 9061, and are conveyed to the left side of the figure by the conveyance belt 913 to pass through the discriminating unit 910. The discriminating unit 910 discriminates paper moneys during a conveyance of the paper moneys. The paper money passed through the discriminating unit 910 is conveyed upward and arrives at a branch point P1 of the conveyance path. When a result of discrimination by the discriminating unit 910 is concerned with a true note of a 1,000-yen bill or a true note of a 10,000-yen bill, a conveyance path directed downward from the branch point P1 by a gate disposed at the branch point P1. On the other hand, when the result of discrimination by the discriminating unit 910 is concerned with a true note of a 5,000-yen bill, a note which is abnormal in shape, etc., a conveyance path directed upward from the branch point P1 by the gate disposed at the branch point P1.

When a paper money is conveyed downward from the branch point P1, the paper money is conveyed along the arrow F1 to the right side of the figure and arrives at a branch point P2. When the result of discrimination by the discriminating unit 910 is concerned with a true note of a 1,000-yen bill, a conveyance path directed to the stacker 901 for 1,000-yen bill is selected by a gate disposed at the branch point P2 so that the paper money is stored in the stacker 901 for 1,000-yen bill by the fetch and receipt mechanism 904. When the result of discrimination by the discriminating unit 910 is concerned with a true note of a 10,000-yen bill, a conveyance path directed from the branch point P2 to the right side of the figure is selected by the gate disposed at the branch point P2 so that the paper money is stored in the stacker 902 for 10,000-yen bill by the fetch and receipt mechanism 904. When a paper money is conveyed upward from the branch point P1, the paper money is conveyed along the arrow F2 to the right side of the figure and arrives at a branch point P3. When the result of discrimination by the discriminating unit 910 is concerned with a 5,000-yen bill, a conveyance path directed to the 5,000-yen bill box 903 is selected by a gate disposed at the branch point P3 so that the paper money is stored in the 5,000-yen bill box 903. When the result of discrimination by the discriminating unit 910 is concerned with a note which is abnormal in shape, etc., a conveyance path directed from the branch point P3 to the right side of the figure is selected by the gate disposed at the branch point P3 so that the paper money abnormal in its shape, etc. is stored in the upper side of the partition plate 9062 of the throw box 906. Thereafter, the throw box 906 is translated to the upper position, so that the paper money abnormal in its shape, etc. stored in the throw box 906 is returned to the user. The 5,000-yen bill stored in the 5,000-yen bill box 903 is transferred by a mechanism (not illustrated) to the 5,000-yen bill chamber 9051 of the reject box 905.

Next, an operation of the BRU 900 in the payment mode will be explained referring to FIG. 13.

The overall control unit 915 controls the fetch and receipt mechanism 904 so that a predetermined sort of money and a predetermined number of sheets of paper money are taken out one by one from the stackers 901 and 902 and conveyed by the conveyance belt 913 via a junction P4 to the right side of the figure. Thereafter, the paper moneys are conveyed upward, and then conveyed to the left side of the figure to pass through the discriminating unit 910. The paper money passed through the discriminating unit 910 is conveyed upward and arrives at a branch point P5 of the conveyance path. When a result of discrimination by the discriminating unit 910 is concerned with a bill abnormal in its shape, etc., a conveyance path directed to the reject box 905 is selected by a gate disposed at the branch point P5, so that the bill abnormal in its shape, etc. are stored in the reject box 905.

When the result of discrimination by the discriminating unit 910 is concerned with a normal bill, a conveyance path directed upward from the branch point P5 is selected by the gate disposed at the branch point P5, so that the paper money is conveyed upward and then conveyed to the right side along the arrow F3 of the figure to be stored in the throw box 906. Thereafter, the throw box 906 is translated upward so that the paper money stored in the throw box 906 is paid to the user.

Next, an operation of the BRU 900 in the supplement mode will be explained referring to FIG. 14.

Here, there will be explained an operation of the BRU 900 in case of no use of a spare cassette. It is noted that an operation of the BRU 900 in case of the use of a spare cassette is similar to an operation which will be described below.

Paper moneys stored in the cassette 907 are taken out one by one by the fetch mechanism 908, and conveyed by the conveyance belt 913 along the arrow F4 to the right side of the figure and further conveyed along the arrow F5 upward and then to the left side of the figure to pass through the discriminating unit 910. A paper money passing through the discriminating unit 910 is first conveyed upward and then downward, and arrives at a branch point P6 of the conveyance path. When a result of discrimination by the discriminating unit 910 is concerned with a bill abnormal in its shape, etc., a conveyance path directed to the cassette 907 is selected by a gate disposed at a branch point P6 so that the bill abnormal in its shape, etc. are stored in the reject chamber 9072 of the cassette 907. When the result of discrimination by the discriminating unit 910 is concerned with a normal paper money, a conveyance path directed downward from the branch point P6 is selected by the gate disposed at the branch point P6. Thereafter, in a similar fashion to that of the money receipt mode, paper moneys are stored in the stackers 901 and 902 in accordance with a sort of money.

Next, an operation of the BRU 900 in the collection mode will be explained referring to FIG. 15.

In similar fashion to that of the supplement mode, there will be described an operation of the BRU 900 in case of no use of a spare cassette.

Paper moneys stored in the stackers 901 and 902 are taken out one by one by the fetch and receipt mechanism 904, and conveyed by the conveyance belt 913 via a junction P7 to the right side of the figure. Thereafter, the paper moneys are conveyed upward, and then conveyed to the left side of the figure to pass through the discriminating unit 910. The paper money passed through the discriminating unit 910 is conveyed upward and arrives at a branch point P8 of the conveyance path. When a result of discrimination by the discriminating unit 910 is concerned with a bill abnormal in its shape, etc., a conveyance path directed to the reject box 905 is selected by a gate disposed at the branch point P8, so that the bill abnormal in its shape, etc. are stored in the reject box 905. When the result of discrimination by the discriminating unit 910 is concerned with a normal bill, a conveyance path directed downward from the branch point P8 is selected by the gate disposed at the branch point P8, so that the paper money is stored in the cassette 907.

It is noted that all of the conveyance velocities of the paper moneys in the above-mentioned four operation modes are the same as one another. Further, it is noted that a certain time is needed for a discrimination of paper moneys by the discriminating unit 910. Thus, the discriminating unit 910 performs a discrimination of paper moneys utilizing a time since a paper money is detected until the paper money arrives at the branch point of the conveyance path. When the paper money arrives at the branch point, the conveyance path is changed over in accordance with a result of discrimination.

In the supplement mode and the collection mode, a large amount of paper moneys such as 1000 sheets at a time is treated. Thus, it is desired that a higher speed for the conveyance of paper moneys is established for a high speed processing of the BRU.

However, increasing the conveyance velocity involves a reduction of the time since a paper money passes through the discriminating unit 910 until the paper money arrives at the branch point. Thus, there is a fear that this brings about too short time for a discrimination to complete the discrimination before the paper money arrives at branch point.

Further, in general, a detection of paper moneys by the discriminating unit depends on a passage speed of the paper money passing through the discriminating unit 910. Consequently, increasing the passage speed of the paper money caused by the increase of the conveyance velocity of paper moneys may bring about a variation of the detection of paper money. Thus, it is difficult to expect an exact discrimination based on a result of detection of paper moneys.

Such a problem is a general problem, but not a problem raised restrictively on the ATM, on a paper processing unit in which a paper is discriminated while being conveyed, and a conveyance path is altered in accordance with a result of discrimination of the paper.

SUMMARY OF THE INVENTION

In view of the foregoing, it is therefore an object of the present invention to provide a paper processing apparatus capable of contributing to increasing a conveyance velocity of papers while a suitable discrimination of the papers is ensured.

To accomplish the above-mentioned object, according to the present invention, there is provided a paper processing apparatus comprising:

a discriminating unit for detecting a paper during conveyance and practicing a predetermined discrimination processing in accordance with a result of detection of the paper to discriminate the paper; and paper conveyance means, having a plurality of operation modes, for conveying the paper along a conveyance path varied in accordance with an operation mode, said conveyance path passing through said discriminating unit regardless of the operation modes, and for altering a conveyance path after passage of said discriminating unit in accordance with a result of discrimination in said discriminating unit, wherein said paper conveyance means conveys papers at least two sorts of conveyance velocity according to the operation modes, and said discriminating unit varies the discrimination processing for papers in accordance with the conveyance velocity for papers.

In a paper processing apparatus having a plurality of operation modes, a discrimination for papers is needed regardless of the operation modes, but in many cases, the contents of the discrimination for papers necessary are different for each operation mode.

In view of the foregoing, according to the paper processing apparatus of the present invention, a conveyance velocity is set up in accordance with an operation mode so as to ensure a discrimination time necessary for the operation mode, and a discrimination processing according to the conveyance velocity is carried out. This feature makes it possible to ensure a suitable discrimination for papers in all of the operation modes, and also to increase the conveyance velocity in some mode, and thereby improving the working efficiency as a whole of the apparatus.

In the paper processing apparatus according to the present invention as mentioned above, it is preferable that the discriminating unit omits part of the discrimination processing for papers in the event that the conveyance velocity for papers is relatively high.

Generally, in order to enhance the discrimination ability, the discrimination processing for papers is performed doubly or trebly, but in the operation mode in which it is desired that a paper is conveyed at high speed, in many cases, there is no need to regard the discrimination ability as important.

For this reason, in the event that a paper is conveyed at high speed, part of the double and treble discrimination processing is omitted to reduce the discrimination time. This feature make it possible to increase the conveyance velocity for papers by the corresponding reduced discrimination time.

Further, in the paper processing apparatus according to the present invention as mentioned above, it is preferable that the discriminating unit varies a discriminating standard in accordance with the conveyance velocity for papers.

According to the paper processing apparatus having such a discriminating unit, a discrimination for papers is performed on the basis of the discriminating standard according to the conveyance velocity. Thus, even if a result of detection of papers by the discriminating unit is varied as the conveyance velocity is increased, the discrimination for papers is performed on the basis of the discriminating standard which meets the altered detection result, and whereby a suitable discrimination for papers is performed.

In the paper processing apparatus according to the present invention as mentioned above, it is acceptable that said discriminating unit detects a paper now on passing through said discriminating unit at regular sampling intervals, and corrects data in such a manner that a ratio of length and breadth of-an image expanded and contracted in accordance with the conveyance velocity for the paper becomes a same ratio as that of length and breadth of an actual paper, and then performs the discrimination processing for the paper.

Practicing the data correction makes it possible to perform a discrimination processing adopting the same algorithm independently of the conveyance velocity, with respect to the algorithm to be executed, other than the omission of part of a discrimination algorithm.

DESCRIPTION OF THE PREFERRED EMBODIMENTS

Hereinafter, there will be described embodiments of the present invention.

Figure 1:
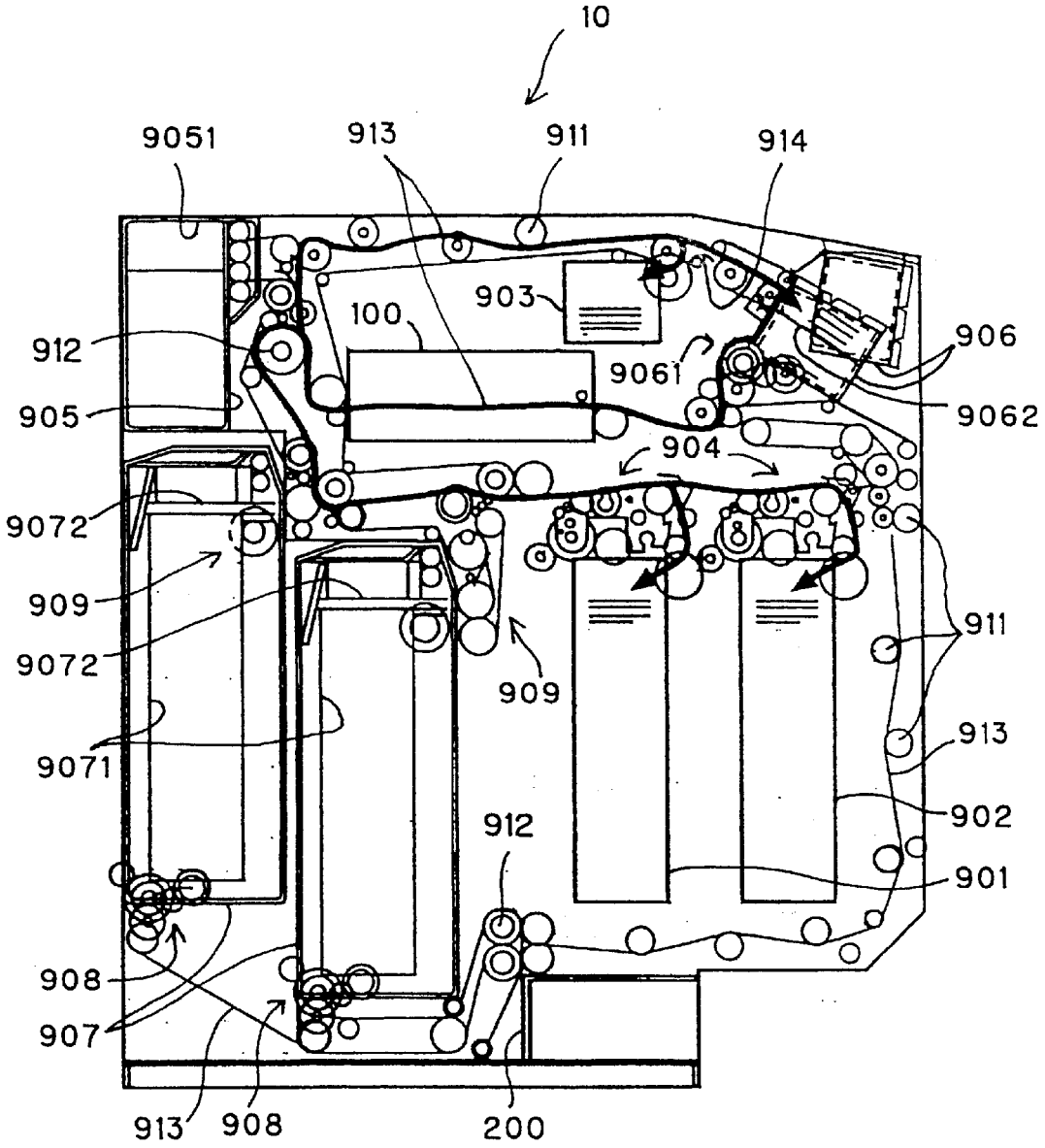
FIG. 1 is a view of a paper processing apparatus according to an embodiment of the present invention.

FIG. 1 is a view showing a BRU which is an embodiment of a paper processing apparatus of the present invention.

The BRU 10 is incorporated into an ATU wherein paper moneys thrown by a certain user are utilized for a payment to another user. In FIG. 1, the same parts are denoted by the same reference numbers as those of FIG. 11, and the redundant description will be omitted.

Figure 11:
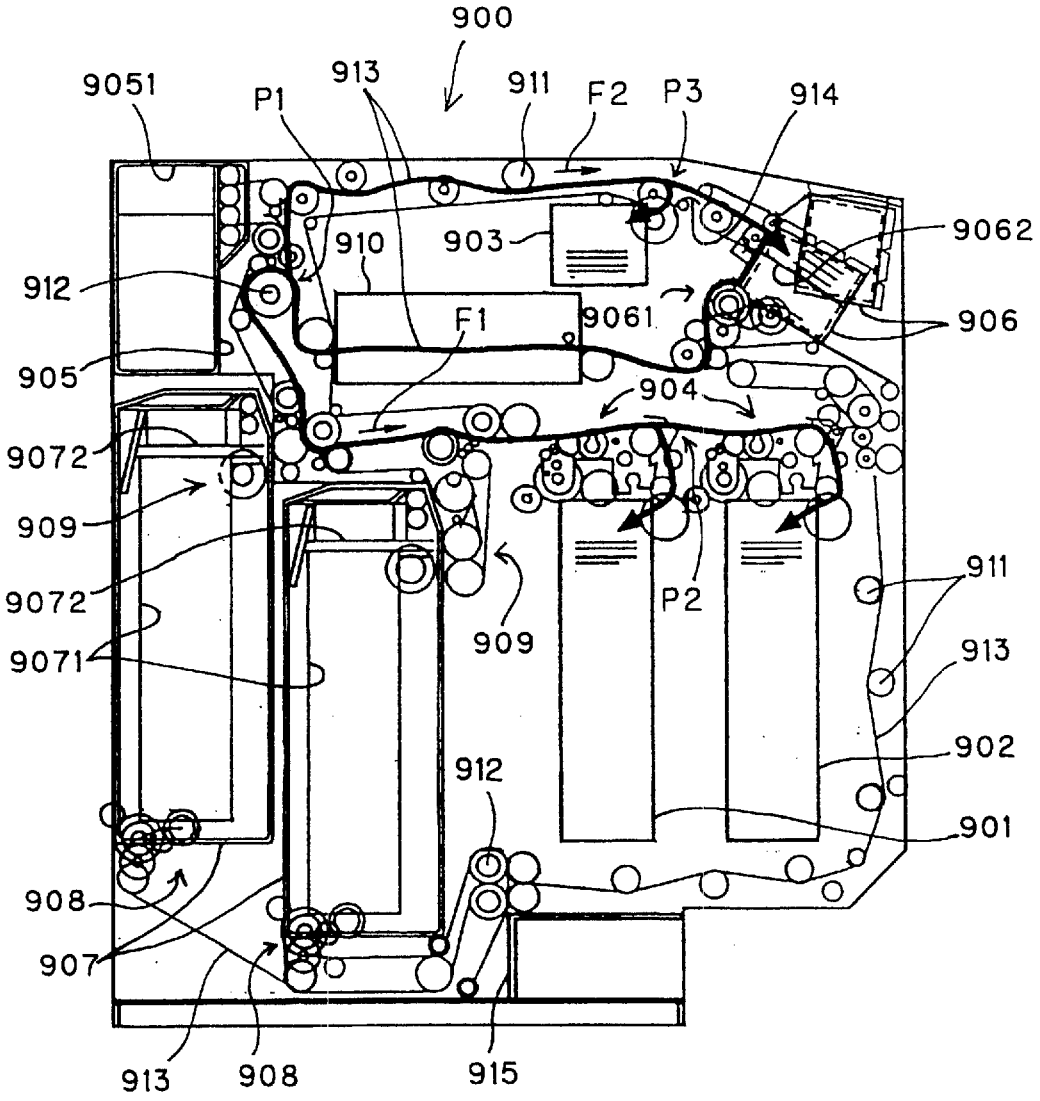
FIG. 11 is a sectional view of the earlier developed BRU.
Figure 12:
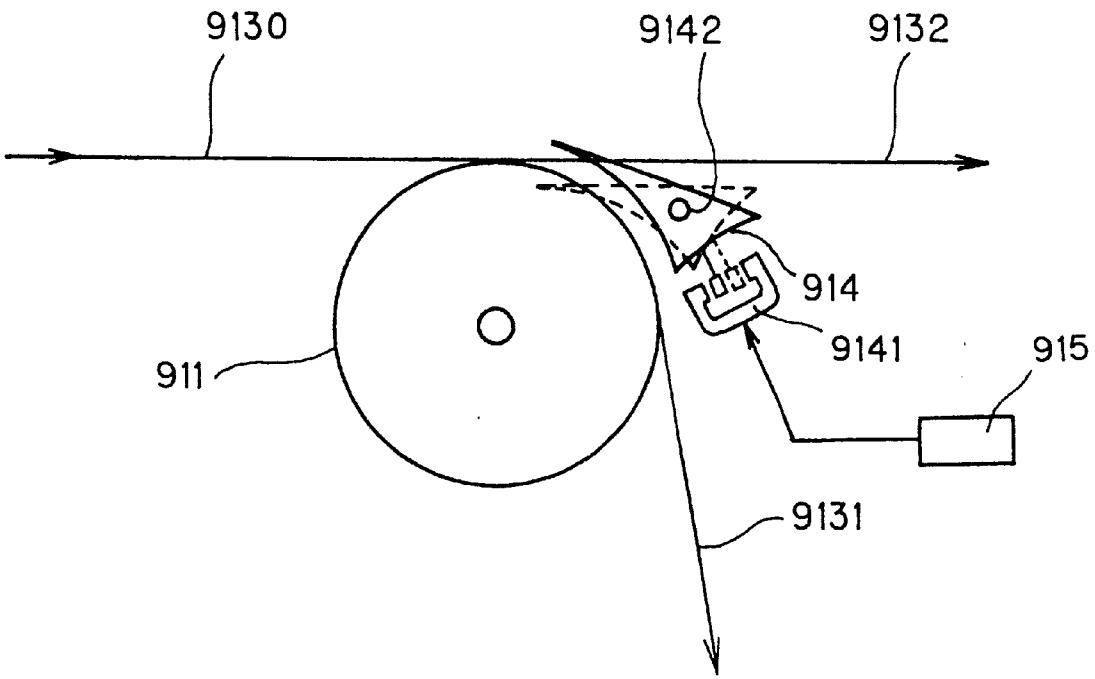
FIG. 12 is a typical illustration useful for understanding a scheme of alteration of a conveyance path by a gate.
Figure 13:
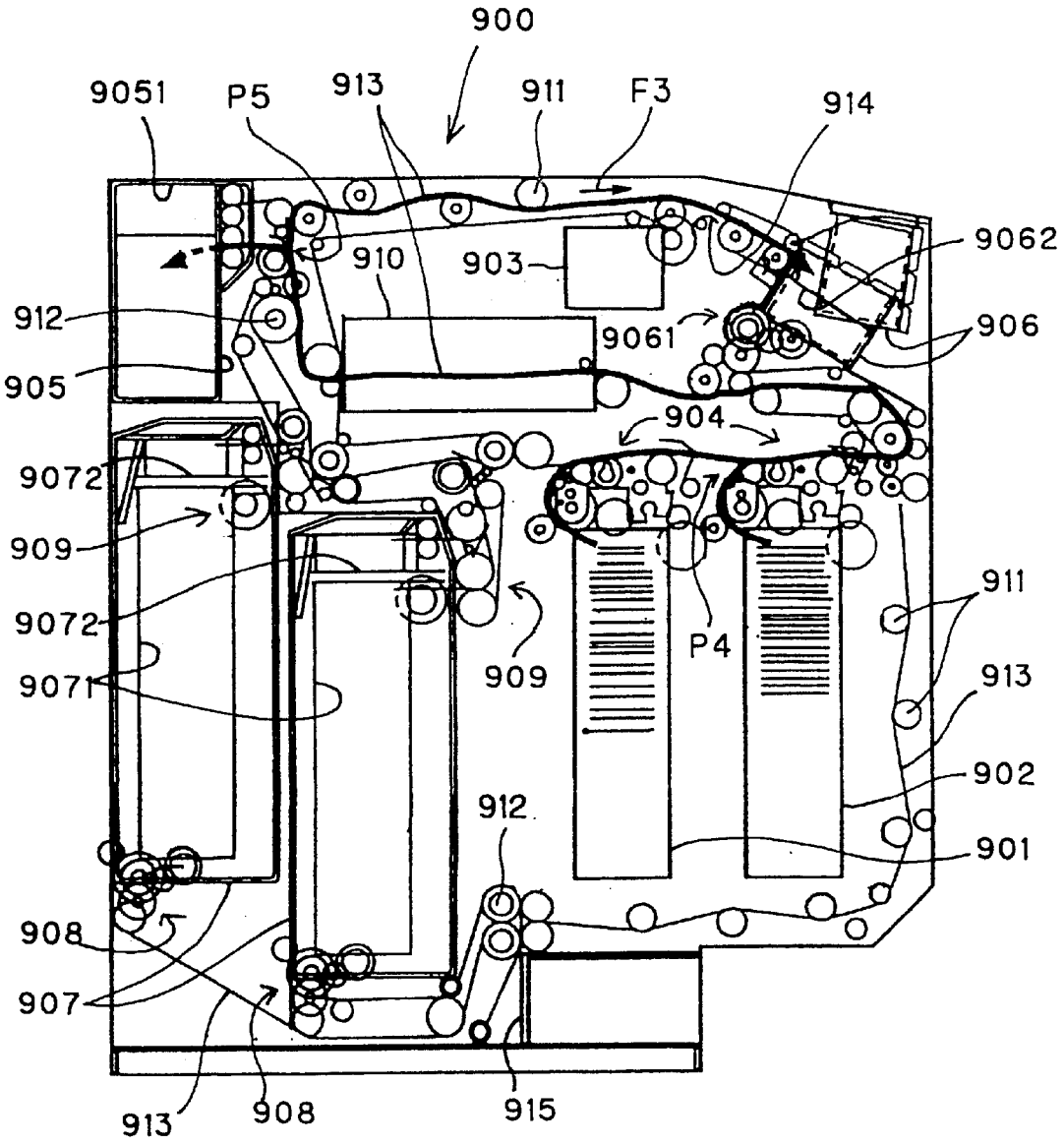
FIG. 13 is a view showing a conveyance path for paper moneys in a payment mode.
Figure 14:
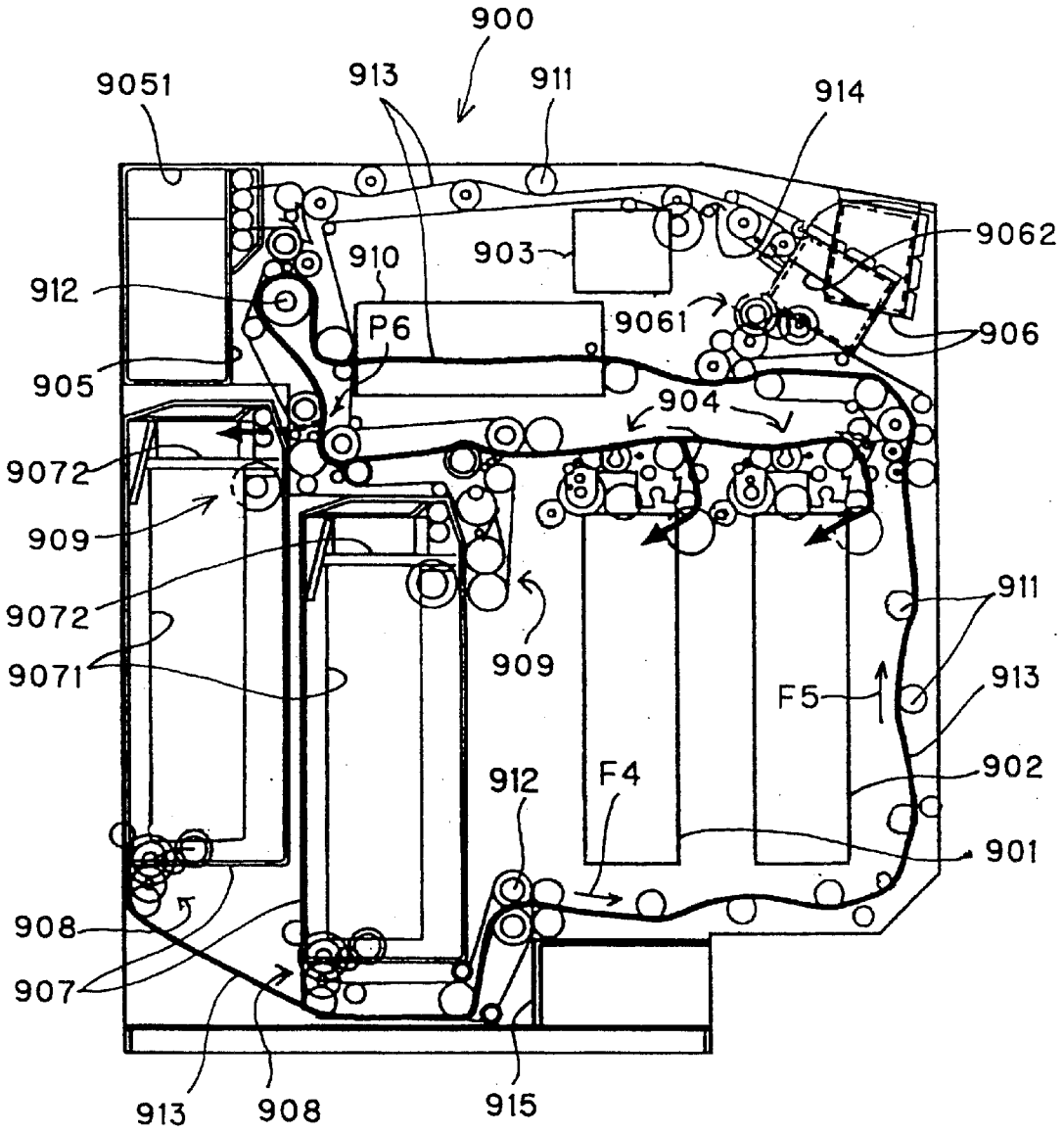
FIG. 14 is a view showing a conveyance path for paper moneys in a supplement mode.
Figure 15:
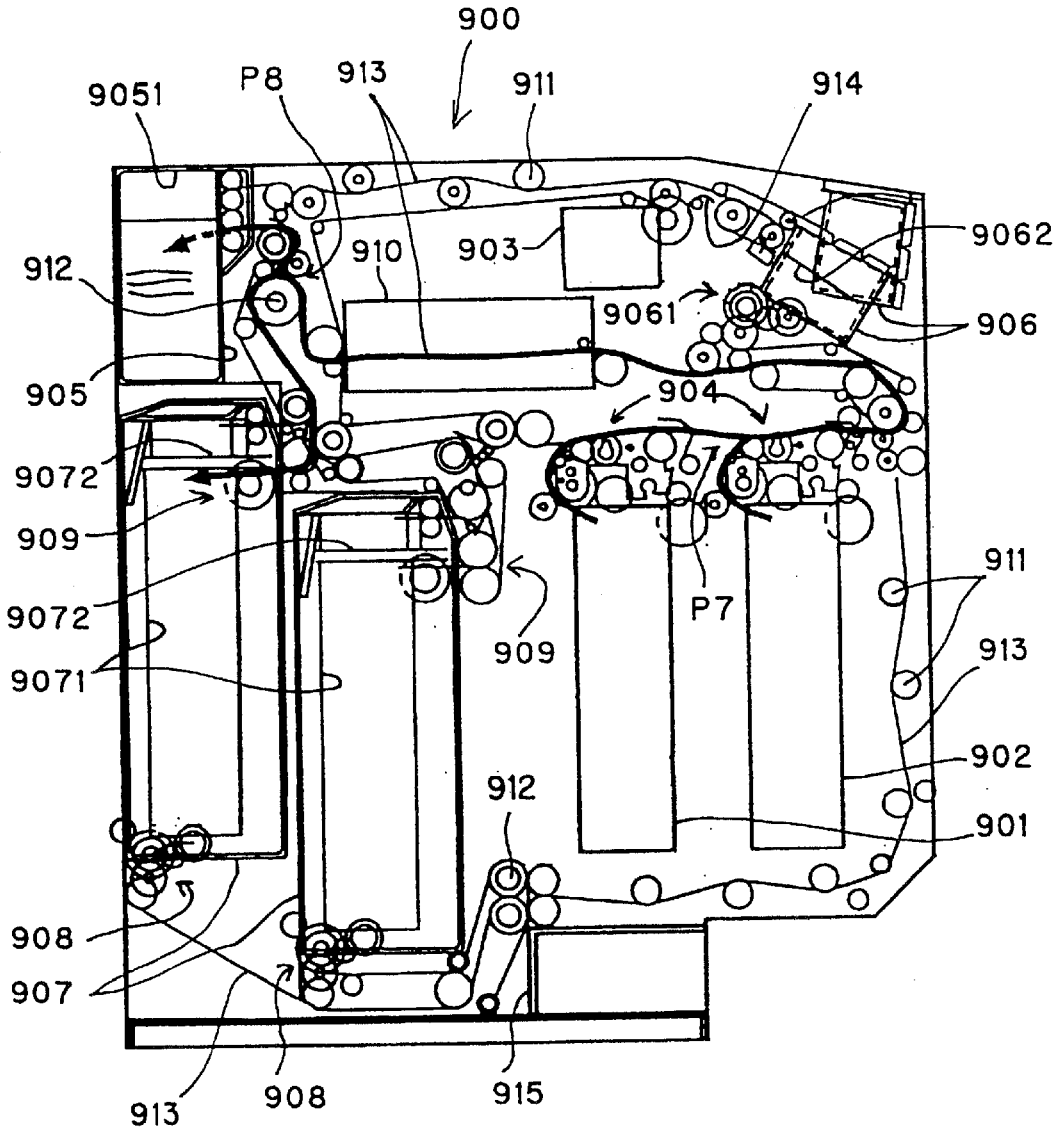
FIG. 15 is a view showing a conveyance path for paper moneys in a collection mode.

In the BRU 900 shown in FIG. 11, the conveyance velocity of paper moneys is a common speed in the four operation modes. To the contrary, in the BRU 10 shown in FIG. 1, the conveyance velocity of paper moneys in the supplement mode and the collection mode is higher speed than that in the money receipt mode and the payment mode. However, with respect to the operation of the BRU 10 shown in FIG. 1, it is completely the same as that of the BRU 900 shown in FIG. 11 which has been explained referring to FIGS. 11–15, and the redundant description will be omitted.

The BRU 10 has a discriminating unit 100 which is an example of a discriminating unit referred to in the present invention. The discriminating unit 100 detects a paper money to generate image data so that a discrimination of paper moneys is performed in accordance with the image data thus obtained. While the discriminating unit 910 of the BRU 900 shown in FIG. 11 performs a common discriminating processing in the respective operation modes, the discriminating unit 100 performs a discriminating processing according to the conveyance velocity of paper moneys. The details of the discriminating unit 100 will be described later.

The BRU 10 further has an overall control unit 200, which is similar to the overall control unit 915 of the BRU 900 shown in FIG. 11, for reading a result of discrimination by the discriminating unit 100 from the discriminating unit 100 to drive the gate 914 in accordance with the discrimination result so that the conveyance path is altered. While the overall control unit 915 of the BRU 900 shown in FIG. 11 performs the common control in the respective operation mode, the overall control unit 200 performs a control according to the operation modes. As will be described hereinafter, the DC motor is controlled in accordance with the operation mode through a control system (not illustrated in FIG. 1), so that the conveyance velocity is controlled in accordance with the operation mode. The overall control unit 200 sends to the discriminating unit 100 a signal indicative of the operation mode.

Figure 2:
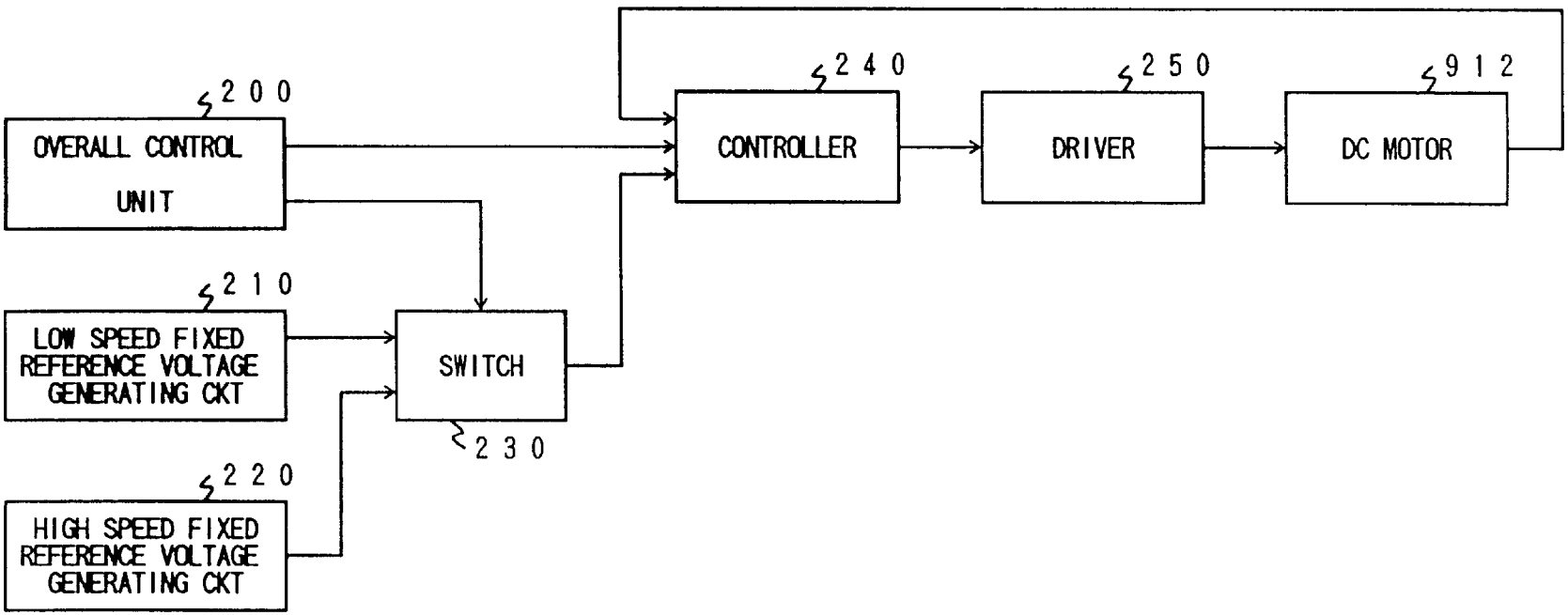
FIG. 2 is a block diagram of a control system in which a DC motor is controlled by an overall control unit.

FIG. 2 is a block diagram of a control system in which a DC motor is controlled by an overall control unit.

The control system comprises a low speed fixed reference voltage generating circuit 210, a high speed fixed reference voltage generating circuit 220, a switch 230, a controller 240 and a driver 250. The low speed fixed reference voltage generating circuit 210 and the high speed fixed reference voltage generating circuit 220 generate two constant voltages, which are mutually different in a voltage value, respectively. The overall control unit 200 controls the switch 230 to select either one of the two constant voltages generated from the low speed fixed reference voltage generating circuit 210 and the high speed fixed reference voltage generating circuit 220.

The driver 250 is a constant-voltage power supply for applying to a DC motor 912 a voltage according to a signal from generated from the controller 240. The controller 240 receives from the overall control unit 200 a control signal to instruct a rotation or a stop of the DC motor 912, and in addition receives the constant voltage selected by the switch 230 as a reference voltage. In the event that the control signal indicates a rotation of the DC motor 912, the controller 240 sends to the driver 250 a signal to indicate a voltage according to the reference voltage. When the control signal indicates a stop of the DC motor 912, the controller 240 sends to the driver 250 a signal to indicate 0 volt. The DC motor 912 outputs a voltage proportional to a rotary speed of the DC motor 912. This voltage is feedbacked to the controller 240. The controller 240 controls the signal to be applied to the driver 250 in accordance with a difference between the feedbacked voltage and the reference voltage.

Figure 3:
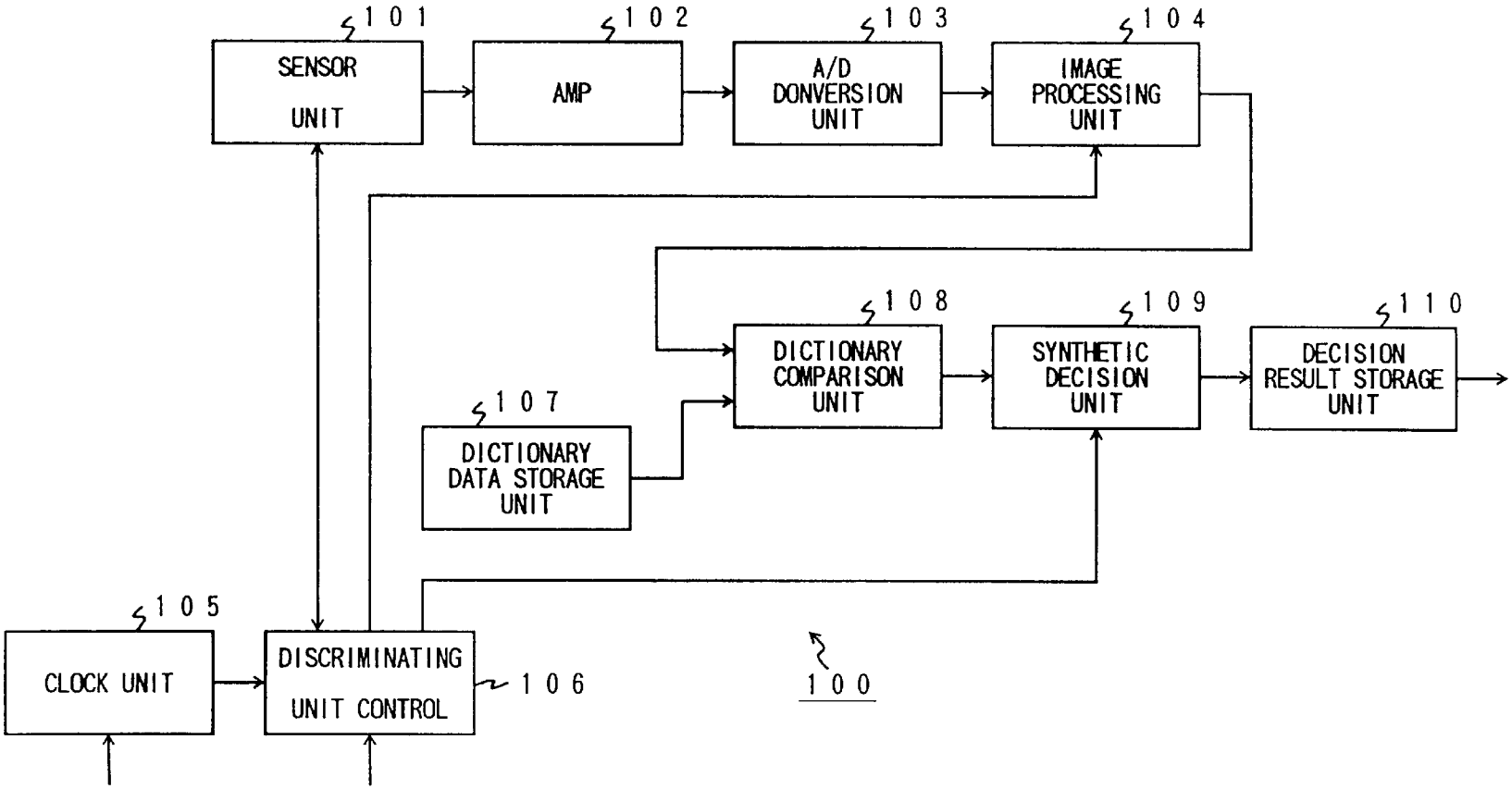
FIG. 3 is a block diagram of a discriminating unit.

FIG. 3 is a block diagram of the discriminating unit shown in FIG. 1.

A discriminating unit 100 comprises a sensor unit 101, an amplifier unit 102, an A/D conversion unit 103 and an image processing unit 104. The sensor unit 101 scans a paper money to derive image data. The amplifier unit 102 amplifies the image data thus obtained. The A/D conversion unit 103 A/D converts the image data amplified by the amplifier unit 102 and then transmits the same to the image processing unit 104.

Figure 4:
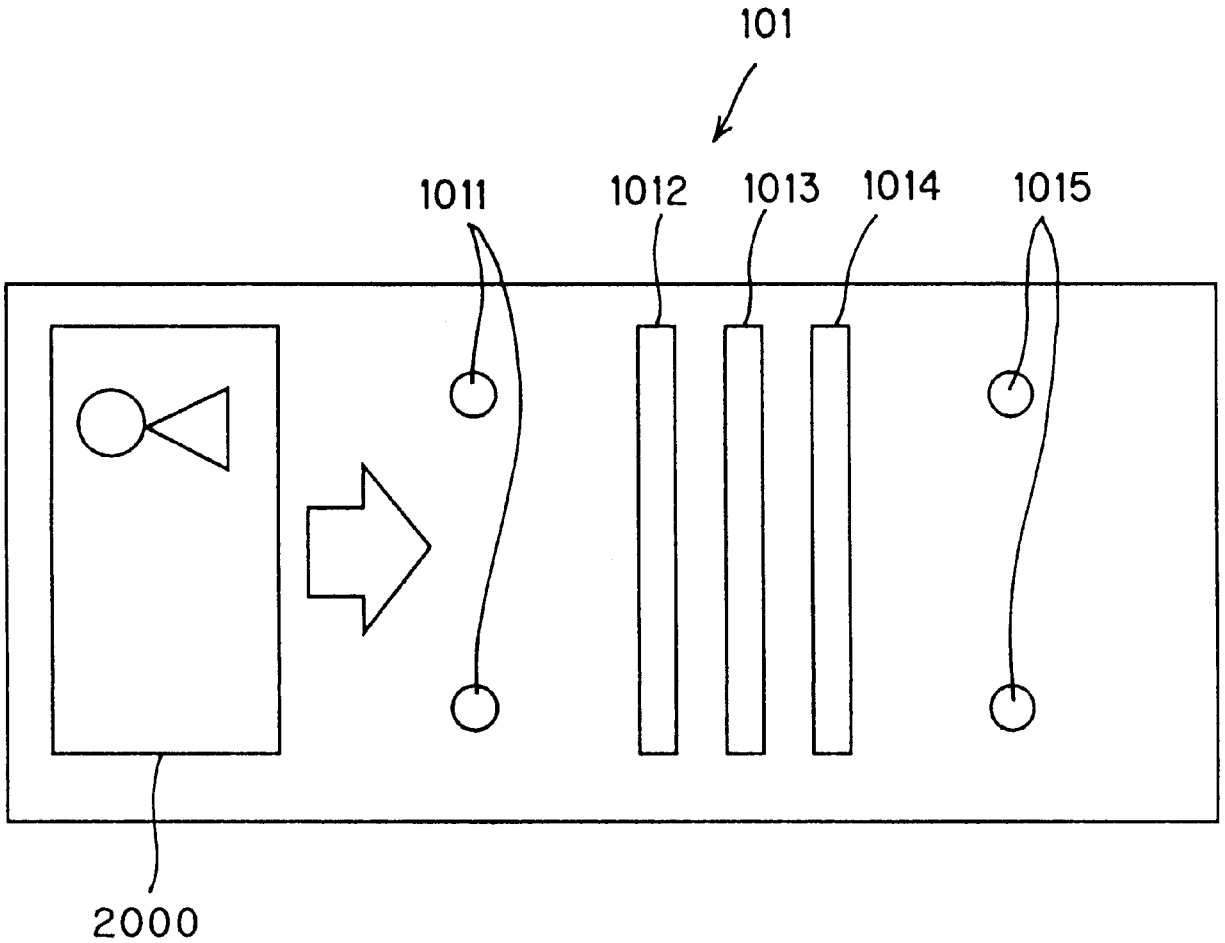
FIG. 4 is a view showing the details of a sensor unit.

FIG. 4 is a view showing the details of the sensor unit shown in FIG. 3.

The sensor unit 101 comprises entry sensors 1011, an optical line sensor 1012, a magnetic line sensor 1013, a thickness sensor 1014, and passage sensors 1015. Paper money 2000 is conveyed from the left side of the figure via the sensor unit 101 to the right side of the figure.

Each of the entry sensors 1011 is a type of an optical sensor, and two such entry sensors 1011 are provided. The entry sensors 1011 detect the conveyed paper money 2000 to obtain detection information which becomes a signal for a start of a predetermined operation of the paper discriminating apparatus 100 shown in FIG. 3. Further, two such entry sensors 1011 individually detect the paper money 2000 to determine a slant of the paper money 2000 with respect to a traveling direction of the paper money 2000 in accordance with a difference between their detected times of the paper money 2000.

Figure 5:
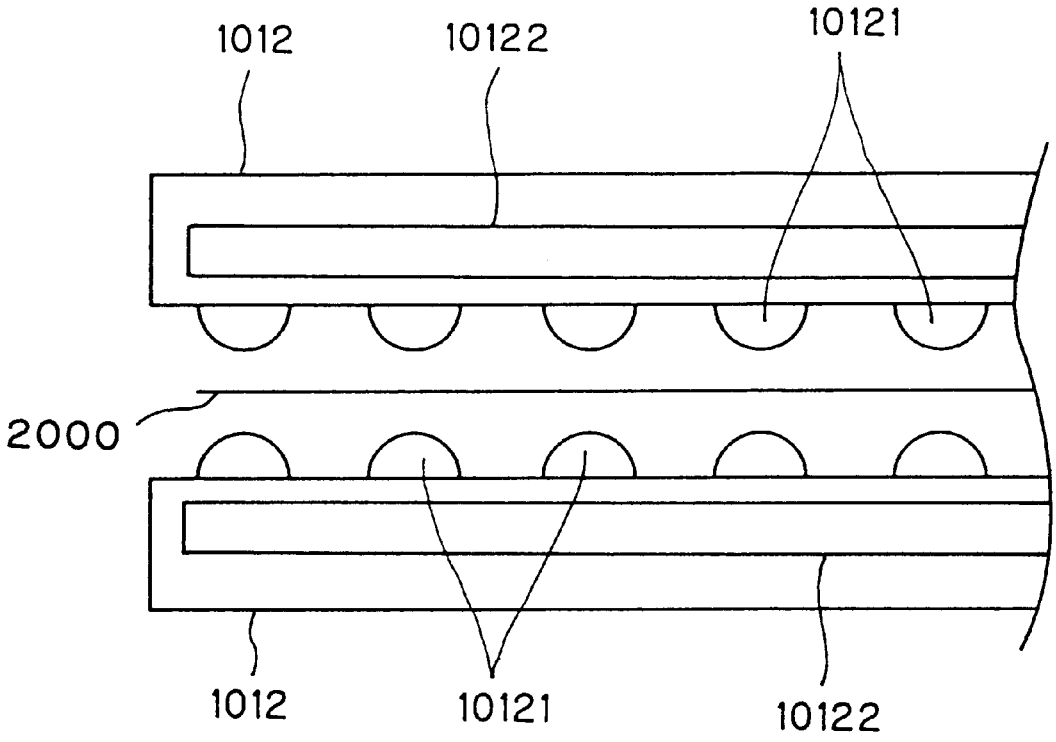
FIG. 5 is a view showing the details of an optical line sensor.

FIG. 5 is a view showing the details of an optical line sensor shown in FIG. 3.

The optical line sensor 1012 comprises 128 pieces of optical sensor device 10121 arranged in a vertical direction (a right and left direction in FIG. 5) with respect to a traveling direction (a direction vertical to a sheet face of FIG. 5) of the paper money 2000. The two optical line sensors 1012 are provided in such a manner that the paper money 2000 is sandwiched between the two optical line sensors 1012. After the paper money is detected by the entry sensors 1011, each of the optical sensor devices 10121 performs 35 times of detection on the paper money at regular intervals. Thus, the paper money 2000 is scanned in the traveling direction by the optical sensor devices 10121 constituting the optical line sensor 1012, and as a result, there is obtained image data representative of a 35×128 mosaic. The details of the image data will be described later.

Each of the optical line sensors 1012 is provided with a light emitting device 10122 for applying light to the paper money 200. These light emitting devices 10122 emit light for each time of the above-mentioned 35 times of detection. The light emitting device 10122 shown in the upper side of FIG. 5 is different from the light emitting device 10122 shown in the lower side of FIG. 5 in timing of light emission. While the light emitting device 10122 shown in the upper side of FIG. 5 emits light, the respective optical sensor devices 10121 shown in the upper side of FIG. 5 detect the paper money 2000 to generate image data as to a face of the upper side of the paper money 2000 shown in FIG. 5 through the reflected light. Simultaneously, while the light emitting device 10122 shown in the upper side of FIG. 5 emits light, the respective optical sensor devices 10121 shown in the lower side of FIG. 5 also detect the paper money 2000 to generate image data through the transmitted light. Likewise, while the light emitting device 10122 shown in the lower side of FIG. 5 emits light, the respective optical sensor devices 10121 shown in the lower side of FIG. 5 detect the paper money 2000 to generate image data as to a face of the lower side of the paper money 2000 shown in FIG. 5 through the reflected light. And simultaneously, while the light emitting device 10122 shown in the lower side of FIG. 5 emits light, the respective optical sensor devices 10121 shown in the upper side of FIG. 5 also detects the paper money 2000 to generate image data through the transmitted light. Of the above-mentioned 4 types of image data, two types of image data due to the transmitted light are added to one another to form a single type of image data.

Figure 6A:
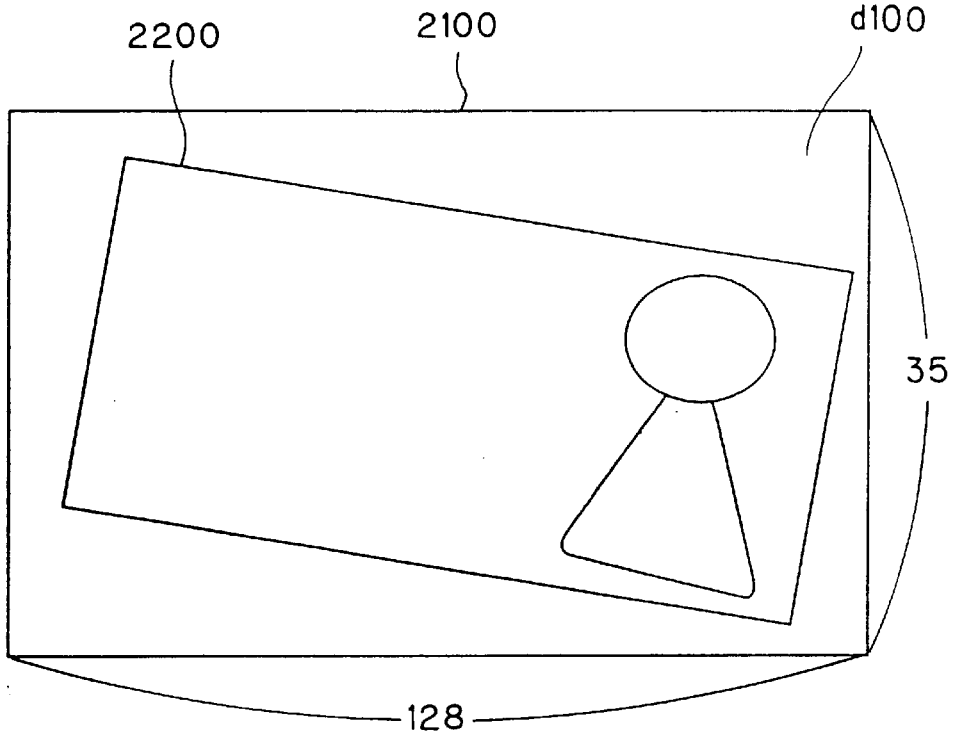
FIG. 6(*a*) is a conceptual view showing image data obtained in a money receipt mode and a payment mode, and FIG. 6(*b*) is a conceptual view showing image data obtained in a supplement mode and a collection mode.
Figure 6B:
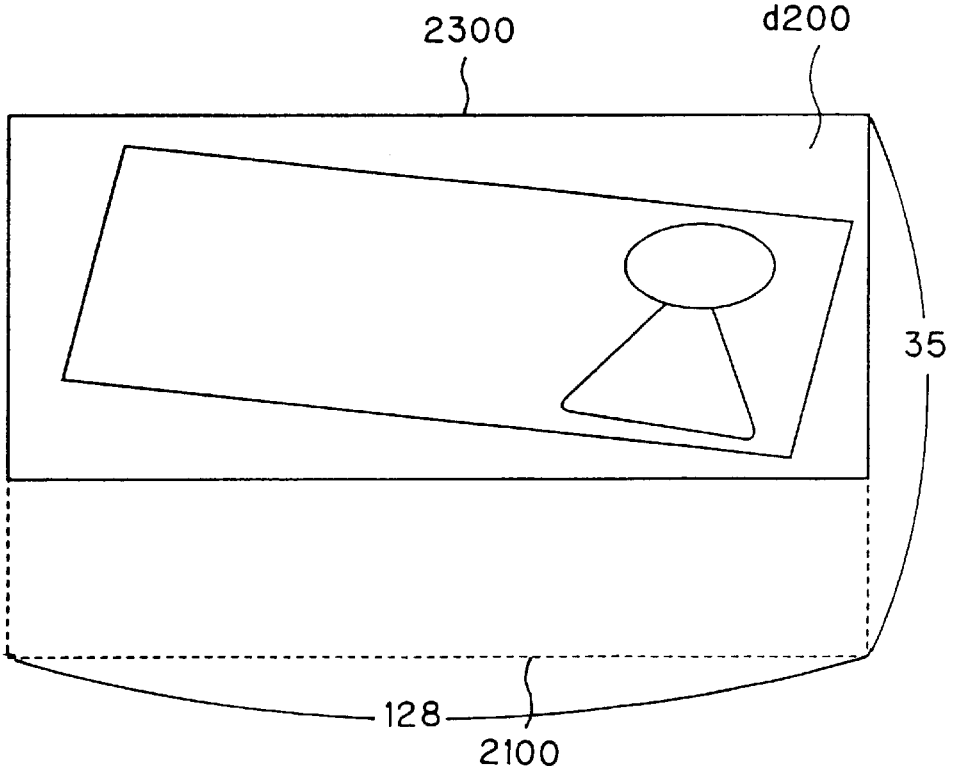

FIG. 6(*a*) is a conceptual view showing image data obtained in a money receipt mode and a payment mode, and FIG. 6(*b*) is a conceptual view showing image data obtained in a supplement mode and a collection mode.

FIG. 6(*a*) shows image data d100 obtained through detection by the optical line sensors of a paper money conveyed at a slant upward the figure, in a money receipt mode and a payment mode. A range 2100 encircled with the most outside of oblong is a range to be scanned by the optical line sensors. An oblong 2200, which is disposed at a slant inside the range 2100 to be scanned by the optical line sensors, denotes an outline of the paper money conveyed at a slant. In this manner, the scanning range 2100 to be scanned by the optical line sensors is broader than the outline 2200 of the paper money. Thus, even if a paper money is conveyed somewhat at a slant, the paper money may stay with the scanning range 2100.

An image depicted in a range 2300 of the oblong of the solid line shown in FIG. 6(*b*) denotes image data d200 obtained in the supplement mode and the collection mode. The image in the range 2300 represents an image in which the image in the range 2100 is reduced in the conveyance direction of the paper money (the vertical direction of the figure). The most outside of oblong, which is depicted by a dotted line in part, corresponds to the scanning range 2100 shown in FIG. 6(*a*).

The conveyance velocity in the supplement mode and the collection mode is higher than that in the money receipt mode and the payment mode. With respect to the sampling intervals of the optical line sensors in the supplement mode and the collection mode, they are the same as those in the money receipt mode and the payment mode. Consequently, the image represented by the image data d200 obtained in the supplement mode and the collection mode is reduced with respect to the vertical direction of the figure as compared with the image represented by the image data d100 obtained in the money receipt mode and the payment mode, and whereby the number of rows of the mosaic image becomes less than 35. For this reason, the image data d200 is corrected so as to produce image data representative of a mosaic of 35×128, similar to the image data d100.

Again referring to FIG. 4, the magnetic line sensor 1013 will be explained.

The magnetic line sensor 1013 is substantially the same as the optical line sensor 1012 except the points that while the optical line sensor 1012 consists of the optical sensor devices being arranged, the magnetic line sensor 1013 consists of the magnetic sensor devices being arranged, and while the optical line sensor 1012 has the light emitting device, the magnetic line sensor 1013 needs no device corresponding to the light emitting device. Further, the magnetic line sensor 1013 is of a single different from the optical line sensor 1012. Thus, according to the single magnetic line sensor 1013, there is obtained image data representative of one magnetic image.

The thickness sensor 1014 is for mechanically measuring thickness of the paper money 2000 to obtain a conveyance direction distribution of the thickness of the paper money 2000.

Each of the passage sensors 1015 is an optical sensor for detecting the paper money 2000, and there are provided two pieces of passage sensors 1015 in a similar fashion to that of the entry sensors 1011. A passage velocity as to the passage of the paper money 2000 through the sensor unit 101 is determined on the basis of a difference between a time in which the paper money 2000 is detected by the entry sensors 1011 and a time in which the paper money 2000 is detected by the passage sensors 1015. The passage velocity thus obtained is used for a synthetic decision which will be described hereinafter.

Again referring to FIG. 3, the discriminating unit 100 further comprises a clock unit 105 and a discriminating unit control 106. The clock unit 105 generates a clock signal. The discriminating unit control 106 receives from the overall control unit 200 of the BRU 10 a signal indicating an operation mode, and performs an overall control for the discriminating unit 100 in accordance with the conveyance velocity of the operation mode indicated by the signal outputted from the overall control unit 200. The discriminating unit control 106 further receives from the entry sensors and the passage sensors of the sensor unit 101 the sensing information of the paper money, and measures the sensing times of the paper money by the respective two entry sensors and two passage sensors, using the clock signal generated in the clock unit 105, to performs the calculation of a slant of the paper money with respect to the conveyance direction and the calculation of a velocity of the paper money passing through the sensor unit 101.

The discriminating unit 100 further comprises an image processing unit 104. The image processing unit 104 receives the image data, which are obtained through the optical line sensors of the sensor unit 101, via the amplifier unit 102 and the A/D conversion unit 103, and applies the image processing (which will be described later) to those image data thus received.

The discriminating unit 100 further comprises a dictionary data storage unit 107 and a dictionary comparison unit 108. The dictionary data storage unit 107 stores dictionary data associated with the respective image data of a whole of a paper money through reflected light, transmitted light and magnetism, and dictionary data associated with a distribution of thickness of a paper money, which dictionary data are a standard against which paper moneys are discriminated. The dictionary comparison unit 108 compares the image data and the distribution of thickness with the dictionary data, so that a check of the shape of paper moneys, a decision of the sort of moneys, and a decision of the authenticity of paper moneys are performed. The details of an operation of the dictionary comparison unit 108 will be described later.

The discriminating unit 100 further comprises a synthetic decision unit 109 and a decision result storage unit 110. The synthetic decision unit 109 makes a decision as to whether a paper money is a valid paper money in accordance with a various types of decision results in the dictionary comparison unit 108, and the slant and the passage speed of the paper money computed in the discriminating unit control 106. A result of this decision is stored in the decision result storage unit 110. The decision result storage unit 110 also stores a result of decision of sort of moneys, and the like. Those results of decision stored in the decision result storage unit 110 are read by the overall control unit 200 of the BRU 10 shown in FIG. 1.

A discriminating processing for papers by the discriminating unit 100 will be described referring to the following flowchart.

Figure 7:
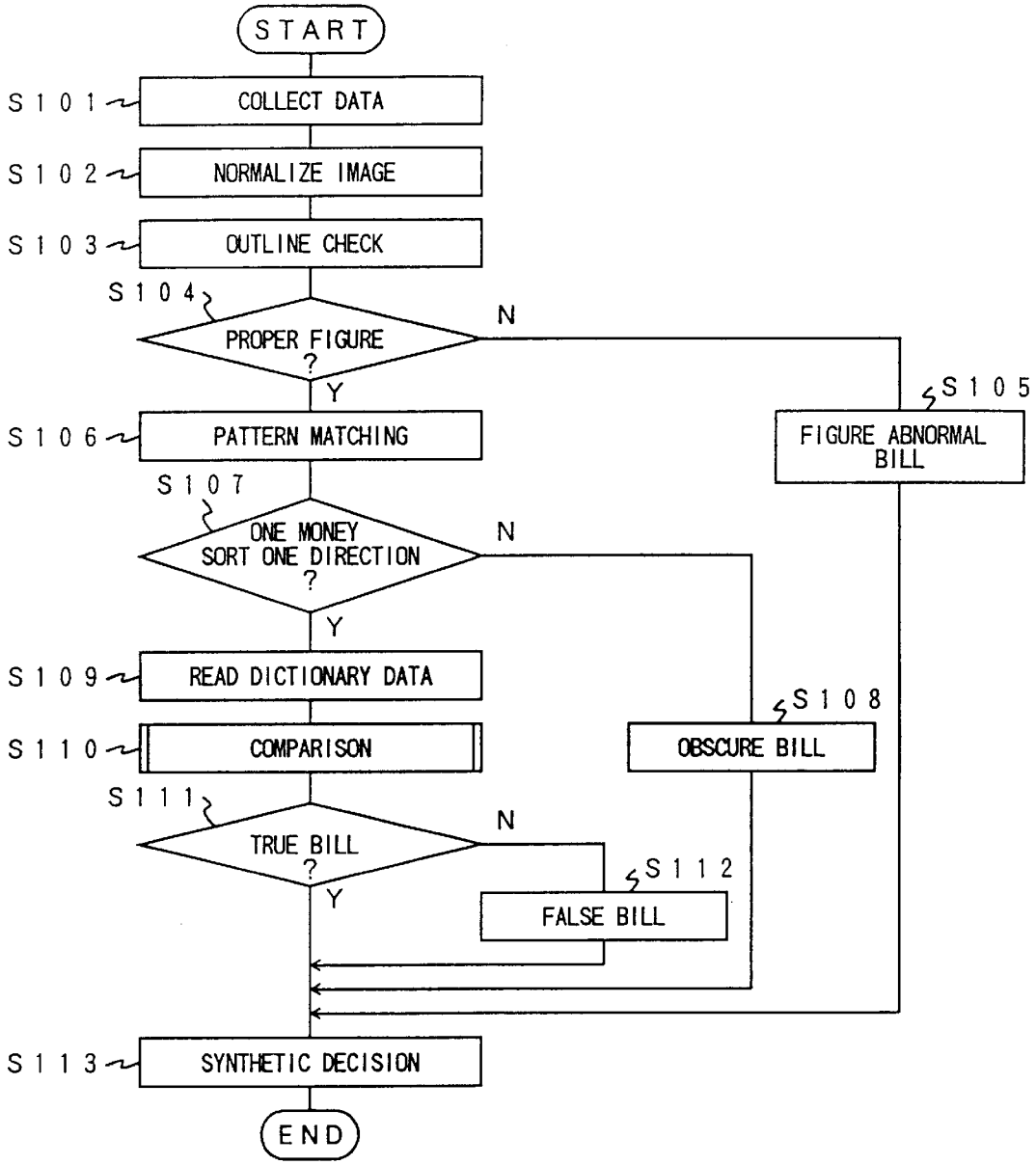
FIG. 7 is a flowchart useful for understanding a discrimination processing for papers.

FIG. 7 is a flowchart useful for understanding a discrimination processing for papers.

When the entry sensor shown in FIG. 4 detects a paper money, the discriminating unit control 106 of the discriminating unit 100 shown in FIG. 3 instructs the start of the detection of paper moneys. First, in a step S101, image data of a whole of a paper money through reflected light, transmitted light and magnetism, and a distribution of thickness of a paper money are collected.

Next, the process goes to a step S102 in which the image processing unit 104 shown in FIG. 3 applies the following image processing to the respective image data collected in the step S101 to perform a normalization for the image data.

First, in the event that the conveyance velocity of a paper money is a high speed, there is made such a correction that a ratio of length and breadth of the image represented by the image data d200 shown in FIG. 6(*b*) becomes the same ratio of length and breadth of the actual paper money, so that image data representative of a mosaic of 35×128, which is the same type as that of the image data d100 shown in FIG. 6(*a*), is generated.

Next, the image data thus generated or the image data shown in FIG. 6(*a*) are corrected as to a slant of paper moneys in such a manner that a paper money is rotated so as to be properly oriented, using the calculated values as to the slant of paper money with respect to the conveyance direction, which calculated values are received from the discriminating unit control 106 shown in FIG. 3. An image inside the range 2400 encircled by the most outside of oblong shown in the upper figure of FIG. 8 denotes image data d300 in which the paper money is properly oriented, obtained as a result of the slant correction. An oblong inside the range 2400 denotes an outline 2500 of the paper money corrected in orientation.

Next, an error due to unevenness of ink density among paper moneys is corrected.

Figure 8:
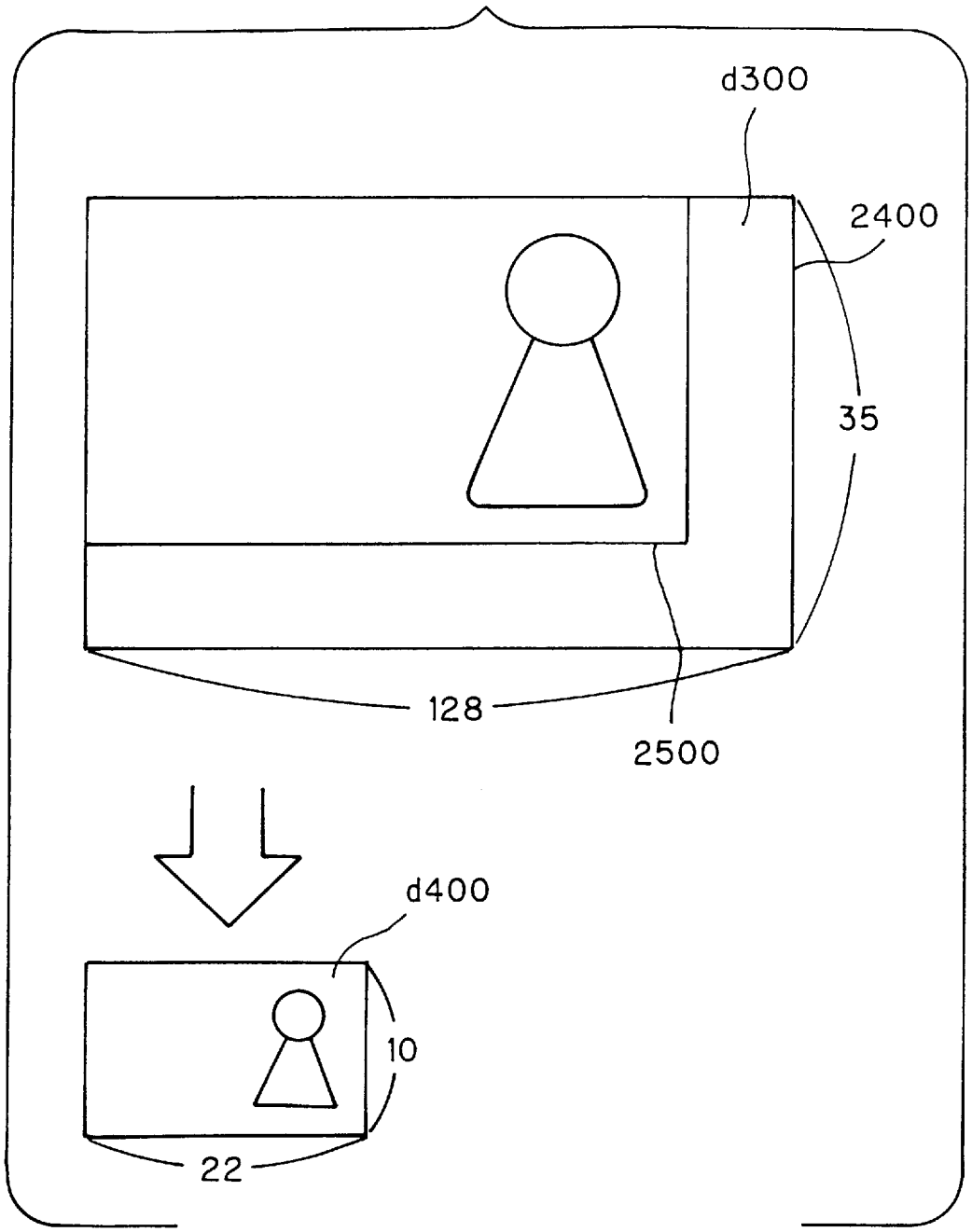
FIG. 8 is a conceptual view showing image data corrected.

Further, image data associated with the range encircled by the outline 2500 is cut out from the image data d300 representative of the mosaic of 35×128 shown in the upper figure of FIG. 8, and the associated image data among a plurality of mosaics included in each of pixels consisting of 10×22 into which the paper money is partitioned are averaged for each pixel, so that image data d400, in which the full range of the paper money is represented by pixels of 10×22, is formed, as shown in the lower figure of FIG. 8.

Practicing the corrections as mentioned above permits the normalization of the image data.

After the normalization of the image data, the process goes to a step S103 in which an outline check for paper moneys is performed on the basis of image data of a paper money in its entirety through transmitted light. In the outline check, the number of damaged portions of the paper money and the magnitude of the damaged portion are checked to determine a total area of the damaged portions of the paper money. Thereafter, the process goes to a step S104 in which it is determined whether the total area of the damaged portions of the paper money is within a range of values which is involved in the figure of the proper paper money. In the step S104, when it is determined that the total area of the damaged portions is out of the range of values which is involved in the figure of the proper paper money, the process goes to a step S105 in which it is determined to be a figure abnormal bill, and then the process goes to a step S113 in which a synthetic decision is made also taking into consideration other decision results and the discrimination processing for the paper money terminates. In the step S104, when it is determined that the total area of the damaged portions is within the range of values which is involved in the figure of the proper paper money, the process goes to a step S106.

In the step S106, there is performed a rough pattern matching between the image data of a paper money in its entirety through transmitted light, which has been normalized in the step S102, and the respective dictionary data each corresponding to the associated image data of a paper money of each sort of money in its entirety through transmitted light, which has been stored in the dictionary data storage unit 107, and a sort of money for paper moneys and a direction of the paper money are specified. Thereafter, the process goes to a step S107 in which it is determined whether the paper money detected in the sensor unit is specified to a one-direction for a one-sort of money in the step S106. In the event that it is decided that the paper money detected in the sensor unit is not specified to a one-direction for a one-sort of money, it is decided that the paper money is regarded as the obscure bill in step S108, and then the process goes to the step S113 in which the synthetic decision is made as mentioned above, and the discrimination processing for the paper money terminates. In the step S107, in the event that the paper money is specified to a one-direction for a one-sort of money, the process goes to a step S109.

In the step S109, as to the sort of money specified in the step S106, dictionary data, which associate with image data through reflected light, image data through transmitted light, image data through magnetism and the thickness distribution, respectively, are read from the dictionary data storage unit 107, and then the process goes to a step S110 in which a comparison routine for comparing the respective image data and the thickness distribution with the dictionary data is executed to obtain a numerical value representative of a result of comparison. When the comparison routine terminates, the process goes to a step S111.

In the step S111, it is determined whether the numerical value representative of the result of comparison in the comparison routine is within a range of a numerical value representative of the true bill. When it is decided that the numerical value representative of the result of comparison is out of the range of the numerical value representative of the true bill, the process goes to a step S112 in which it is decided that the paper money is a false bill, and then the process goes to the step S113. In the step S111, when it is decided that the numerical value representative of the result of comparison is within the range of the numerical value representative of the true bill, the paper money is regarded as the true bill, and the process goes to the step S113.

In the step S113, the synthetic decision unit 109 shown in FIG. 3 reads calculated values of the slant and the passage velocity from the discriminating unit control 106, and there is made a decision as to whether the paper money of interest is to be treated as a proper money in accordance with the calculated values thus read and the above-mentioned various types of decision results, so that a result of this decision and the decision results of the sort of money are stored in the decision result storage unit 110, and then the discrimination processing for the paper money terminates.

Hereinafter, the comparison routine in the step S110 will be described.

In the comparison routine, as mentioned above, the respective image data and the thickness distribution are compared with the dictionary data. The image data to be used for comparison is the image data normalized in the step S102 of FIG. 7, or the image data d400 in which the full range of the paper money is represented by the pixels of 10×22, as shown in the lower figure of FIG. 8.

The dictionary data associated the image data are produced on the basis of a large number of image data which are obtained by scanning a large number of paper moneys, and are prepared in association with image data through reflected light, image data through transmitted light, image data through magnetism and the thickness distribution, respectively. Further, there are prepared dictionary data each corresponding to the associated combination of two pieces of the respective image data and the thickness distribution.

With respect to the dictionary data, there are prepared the following four types of dictionary data, that is, a first dictionary data consisting of the respective mean values in which image data of a large number of paper moneys are averaged for each pixel of 10 rows×22 columns, and the respective standard deviations for each pixel of the image data; a second dictionary data consisting of the respective mean values in which the respective row data, which are generated through averaging image data of a sheet of paper money for each row of pixel of 10 rows×22 columns, are averaged for each row on a large number of paper moneys, and the respective standard deviations for each row of the row data; a third dictionary data consisting of the respective mean values in which the respective column data, which are generated through averaging image data of a sheet of paper money for each column of pixel of 10 rows×22 columns, are averaged for each column on a large number of paper moneys, and the respective standard deviations for each column of the column data; and a fourth dictionary data consisting of the mean value in which full range data, which are generated through averaging image data of a sheet of paper money over the full range of the paper money, are averaged on a large number of paper moneys, and the standard deviation of the full range data. The reason why those four types of dictionary data are prepared is that they are utilized for discrimination suitable for each of the four types of dictionary data, as there is a case where for example, a paper money, which is dark in its entirety, or a paper money, which is partially repapered, cannot be discriminated by a comparison using dictionary data consisting of the mean values and the like for each pixel,but can be discriminated by a comparison using dictionary data consisting of the meanvalues of the full range data and the like. When dictionary data is compared with image data,those four types of dictionary data are not always adopted, and all or part of those four types of dictionary data are selected by a manager of the ATM to be used for a comparison with image data. Hereinafter, the explanation will be continued assuming that the first dictionary data, that is, the dictionary data consisting of the respective mean values in which image data of a large number of paper moneys are averaged for each pixel of 10 rows×22 columns, and the respective standard deviations for each pixel of the image data, is used to be compared with image data.

A comparison of image data with dictionary data is performed in such a manner that it is decided for each pixel whether a value of the image data is within a range of a reference limit which is determined in accordance with the mean values and the standard deviations constituting the dictionary data, as will be described later. When it is decided that the value of the image data is within the range of the reference limit, the pixel is regarded as being "true" . When it is decided that the value of the image data is out of the range of the reference limit, the pixel is 7=regarded as being "false". After the check is completed as to a whole of pixels, the number of pixels, which are regarded as being "false", is determined in the form of a result of the comparison.

Figure 9:
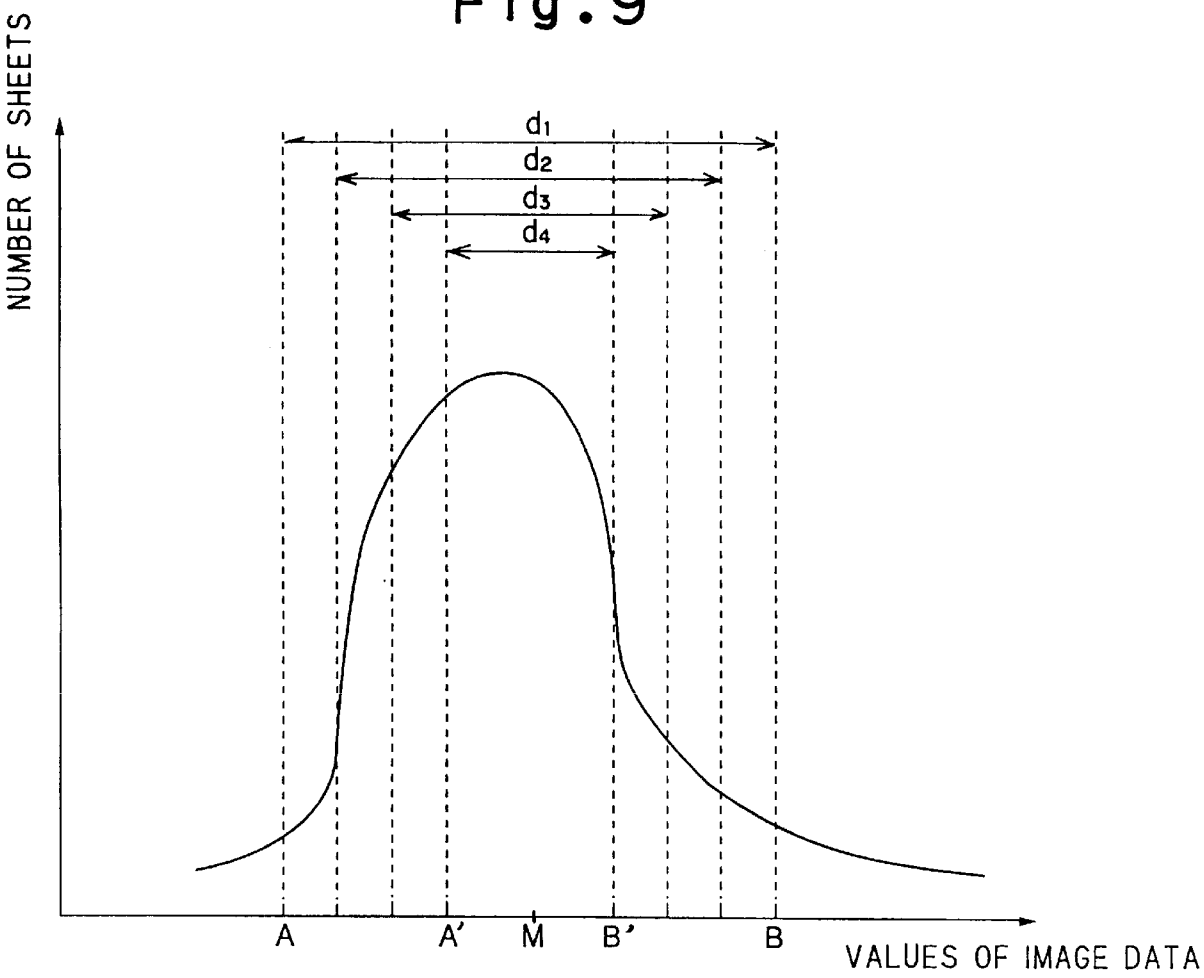
FIG. 9 is a view showing a reference range.

FIG. 9 is a view showing a reference range.

In FIG. 9, a curve having a peak in the center indicates a distribution of a large number of image data collected, in order to make up dictionary data, on a certain pixel. The axis of abscissas stands for values of image data, and the axis of ordinates stands for the number of sheets of paper money. The point M on the axis of abscissas indicates the mean value of the image data.

As mentioned above, a standard deviation of the distribution shown in this graph is included in dictionary data in the form of part of the dictionary data. Adding to the mean value a value which is obtained by means of multiplying the standard deviation by a predetermined factor may determine the upper limit of the reference range, and subtracting the value thus obtained from the mean value may determine the lower limit of the reference range. Examples of the lower limit and the upper limit determined in this manner are expressed by points A and B on the axis of abscissas of FIG. 9, respectively. And other examples of the lower limit and the upper limit are expressed by points A' and B', respectively. The points A and B, or the points A' and B' are determined by varying the factor of the multiplication for the standard deviation. A plurality of dotted lines, which are parallel to the axis of ordinates of the graph, denote various lower limits and upper limits computed in accordance with various factors. A plurality of arrows, which are parallel to the axis of abscissas of the graph, denote reference ranges $d_1$, $d_2$, $d_3$, $d_4$ associated with various factors, respectively.

Image data, which is obtained in the supplement mode and the collection mode involved in the operation mode wherein the conveyance velocity for paper moneys is high speed, is the image data d200 shown in FIG. 6(*b*). As mentioned above, since the number of rows of the mosaic represented by this image data is less than 35, information content of this image data is less than that of the image data d100 shown in FIG. 6(*a*), which is representative of the mosaic of 35×128, obtained in the money receipt mode and the payment mode involved in the operation mode wherein the conveyance velocity for paper moneys is low speed. Consequently, the image data representative of the mosaic of 35×128, which is obtained through correction of the image in ratio of length and breadth by the image processing unit on the basis of the image data obtained in the supplement mode and the collection mode, includes the correction error.

Providing that the common reference range is adopted in the respective operation modes and is the reference range $d_2$ in FIG. 9, it is expected in the money receipt mode and the payment mode that there is a low probability such that the image data deviates from the reference range, since the reference range $d_2$ covers the greater part of the distribution represented by the curve shown in FIG. 9. On the other hand, in the supplement mode and the collection mode, the image data is prone to deviate from the reference range owing to the above-mentioned correction error. Thus, in the supplement mode and the collection mode, a lot of true bills will be discriminated to be false bills.

In view of the foregoing, according to the present embodiment, as the factor for computing the reference range in the supplement mode and the collection mode, there is adopted a factor which is larger in the value than that of the factor for computing the reference range in the money receipt mode and the payment mode. Thus, a probability that the image data deviates from the reference range in the supplement mode and the collection mode is adjusted to be substantially the same as a probability that the image data deviates from the reference range in the money receipt mode and the payment mode.

Figure 10:
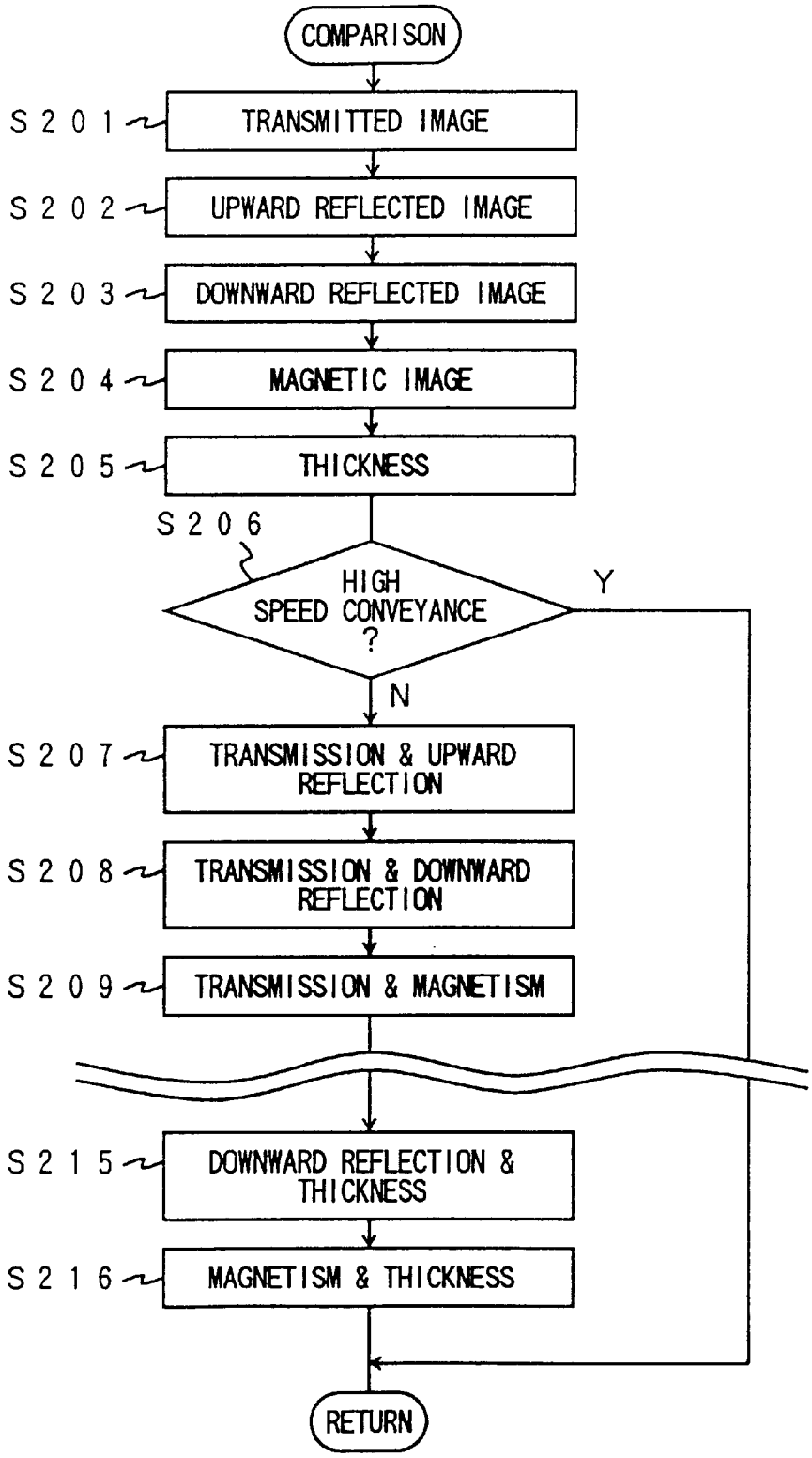
FIG. 10 is a flowchart useful for understanding a comparison routine.

FIG. 10 is a flowchart useful for understanding a comparison routine.

In steps S201–S205 of the comparison routine, image data through transmitted light, image data as to both sides of a paper money through reflected light, image data through magnetism and thickness distribution are compared with the associated dictionary data, respectively. After the comparison of the steps S201–S205 is completed, the process goes to step S206.

In the step S206, it is determined whether the conveyance velocity for a paper money is a high speed. When it is decided that the conveyance velocity for a paper money is a high speed, the process returns to the discrimination processing shown in FIG. 7. In the step S206, when it is decided that the conveyance velocity for a paper money is not a high speed, the process goes to a step S207 to continue the comparison.

In steps S207–S216 (steps S210–S214 are omitted), there are performed comparisons of data, which are obtained through respective combinations of two pieces of the image data through transmitted light, the image data as to both sides of a paper money through reflected light, the image data through magnetism and the thickness distribution in such a predetermined manner that for example, individual two pieces are added to each other for each pixel, or are subjected to the subtraction for each pixel, with the dictionary data corresponding to the associated combinations, respectively. Combination of image data and the like in units of two pieces may discriminate even false bills which are not discriminated by any combinations through the steps S201–S205.

After the comparisons in the steps S207–S216 are terminated, the process returns to the discrimination processing for paper moneys shown in FIG. 7.

In the money receipt mode and the payment mode, paper moneys are delivered between a user of an ATM and the ATM. For this reason, it is desired that a discrimination ability for false bills is enhanced as much as possible, and thus the comparisons in the steps S207–S216 are performed. Further, the conveyance velocity for paper moneys is selected to be such an extent of low speed that an arrival time, starting from departure of a paper money from the discrimination unit up to arriving at the first branch point of the conveyance path, is just over a time required for a discrimination for the paper money.

On the other hand, the supplement mode and the collection mode are the operation mode for maintenance and management of an ATM by a manager of the ATM, and thus it is acceptable that the discrimination ability for paper moneys is low. Further, in the supplement mode and the collection mode, it is usual that a lot of paper moneys more than 1000 sheets are treated. For this reason, it is desired that a higher speed of conveyance velocity is provided as much as possible to contribute to reduction of working time for the maintenance and management of the ATM.

Thus, according to the present embodiments, in the supplement mode and the collection mode, the comparisons in the steps S207–S216 are not performed to reduce time required for discrimination of paper moneys, and thereby providing a higher speed of conveyance velocity for paper moneys in the supplement mode and the collection mode.

Incidentally, while the paper processing apparatus according to the present embodiment has two types of conveyance velocity for paper moneys, it is acceptable that the paper processing apparatus according to the present invention has three or more types of conveyance velocity for paper moneys.

Further, according to the paper processing apparatus of the present embodiment, in the supplement mode and the collection mode, there are omitted the comparisons in the steps S207–S216 shown in FIG. 10. However, in the paper processing apparatus according to the present invention, it is acceptable that only part of the comparisons in the steps S207–S216 is omitted, alternatively, a whole of the comparison routine shown in FIG. 10 is omitted.

Furthermore, according to the paper processing apparatus of the present embodiment, the numerical range, with which paper moneys are regarded as true bills, for discriminating paper moneys in accordance with a result of the comparisons, is fixed regardless of the conveyance velocity. However, in the paper processing apparatus according to the present invention, it is acceptable that the numerical range, with which paper moneys are regarded as true bills, is determined in accordance with the conveyance velocity.

As mentioned above, according to the paper processing apparatus of the present invention, it is possible to ensure a suitable discrimination of paper moneys, and in addition to enhance the conveyance velocity for paper moneys.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

I claim:

1. A paper processing apparatus comprising:

a discriminating unit for detecting a paper during conveyance and practicing a predetermined discrimination processing in accordance with a result of detection of the paper to discriminate the paper; and paper conveyance means, having a plurality of operation modes, for conveying the paper along a conveyance path varied in accordance with an operation mode, said conveyance path passing through said discriminating unit regardless of the operation modes, and for altering a conveyance path after passage of said discriminating unit in accordance with a result of discrimination in said discriminating unit, wherein said paper conveyance means conveys papers at at least two sorts of conveyance velocity according to the operation modes, and said discriminating unit varies the discrimination processing for papers in accordance with the conveyance velocity for papers.

2. A paper processing apparatus according to claim 1, wherein said discriminating unit omits part of the discrimination processing for papers in the event that the conveyance velocity for papers is relatively high.

3. A paper processing apparatus according to claim 1, wherein said discriminating unit varies a discriminating standard in accordance with the conveyance velocity for papers.

4. A paper processing apparatus according to claim 1, wherein said discriminating unit detects a paper now on passing through said discriminating unit at regular sampling intervals, and corrects data in such a manner that a ratio of length and breadth of an image expanded and contracted in accordance with the conveyance velocity for the paper becomes a same ratio as that of length and breadth of an actual paper, and then performs the discrimination processing for the paper.

* * * * *